US005715717A

United States Patent [19]

Widen

[11] Patent Number: 5,715,717

[45] Date of Patent: Feb. 10, 1998

[54] CYLINDER LOCK AND KEY COMBINATION INCLUDING A PROFILED KEY

[76] Inventor: Bo Widen, Box 37, S-644 00, Torshalla, Sweden

[21] Appl. No.: 757,094

[22] Filed: Dec. 2, 1996

Related U.S. Application Data

[63] Continuation of Ser. No. 278,009, Jul. 20, 1994, abandoned.

[30] Foreign Application Priority Data

Dec. 30, 1993 [SE] Sweden ..... 9304353

[51] Int. Cl.[6] ..... E05B 15/08

[52] U.S. Cl. ..... 70/493; 70/406; 70/409; 70/419; 70/420; 70/453

[58] Field of Search ..... 70/347, 356, 419–421, 70/453, 409, 405–407, 493–496

[56] References Cited

U.S. PATENT DOCUMENTS

| | | | |
|---|---|---|---|
| 1,244,450 | 10/1917 | Christoph | 70/406 |
| 2,023,207 | 12/1935 | Olson | 70/406 |
| 3,393,542 | 7/1968 | Crepinsek | 70/493 X |
| 3,413,831 | 12/1968 | Crepinsek | 70/406 |
| 3,742,744 | 7/1973 | Lumme | 70/421 X |

FOREIGN PATENT DOCUMENTS

| | | | |
|---|---|---|---|
| 0123192 | 10/1984 | European Pat. Off. . | |
| 748276 | 7/1933 | France | 70/409 |
| 935900 | 7/1948 | France | 70/493 |
| 2565281 | 12/1985 | France . | |
| 3136314 | 3/1983 | Germany . | |
| 3225952 | 1/1984 | Germany . | |
| 3314417 | 10/1984 | Germany . | |
| 3314511 | 10/1984 | Germany | 70/406 |
| 3817494 | 11/1989 | Germany | 70/493 |
| 4035934 | 6/1991 | Germany | 70/356 |
| 4205643 | 8/1993 | Germany . | |
| 9202094 | 1/1994 | Sweden . | |
| WO8704748 | 8/1987 | WIPO . | |
| WO8704749 | 8/1987 | WIPO . | |
| WO8906733 | 7/1989 | WIPO . | |
| WO9401643 | 1/1994 | WIPO . | |

*Primary Examiner*—Lloyd A. Gall
*Attorney, Agent, or Firm*—Sughrue, Mion, Zinn, Macpeak & Seas, PLLC

[57] ABSTRACT

A cylinder lock and key combination, where the key (20) has an undercut profile groove (24) at one side surface (22) thereof and, in the key slot (13), the lock key plug has a corresponding profile tongue (15) with a downwardly projecting end portion (15*a*), which fills up the undercut portion (29) of the key profile groove (24) upon insertion of the key into the lock.

25 Claims, 7 Drawing Sheets

CYLINDER LOCK AND KEY COMBINATION INCLUDING A PROFILED KEY

This is a Continuation of application Ser. No. 08/278,009 filed Jul. 20, 1994, now abandoned.

BACKGROUND OF THE INVENTION

1. Field of the Invention

The present invention relates to a cylinder lock and key combination. The present invention also relates to a corresponding key, a key blank for manufacturing such a key and a corresponding lock.

2. Description of the Related Art

Lock and key combinations of the kind indicated above are generally known, e.g., from WO87/04749 (Widén Innovation AB). Normally, a key has two or more profile grooves in each side surface, and the lock has corresponding profile ridges which define the key slot. By variation of the profile groove locations and depths and the corresponding profile ridges in terms of number and geometrical shape, it is possible to obtain a great number of unique patterns, apart from the modification possibilities related to the locking tumblers of the lock and the corresponding coded recesses in the key.

Profile grooves having a V-shape or a rectangular shape are typical. Often, the profile groove is widened towards the opening of the profile groove. In other types of keys, profile grooves having cylindrically curved flanks have been proposed. Compare, e.g., EP-B1-0 123 192 (Karrenberg).

In spite of the great possibilities of variation in terms of numbers and shapes of the profile grooves, the possibilities have been practically exhausted, and a plurality of different profile grooves exist today as standards for key blanks. Often, in key systems, the base portion of the key blade is substantially constant, whereas the profile cross section of the upper part of the key blade is varied.

SUMMARY OF THE INVENTION

A main object of the present invention is therefore to achieve a cylinder lock and key combination having a new type of profile grooves in flat keys, so that the variation possibilities are further increased and, moreover, a higher degree of security against unauthorized key copying is obtained.

Further, secondary objects are to improve the resistance against picking the lock and to obtain a large material region in the side surface of the key adjacent to a profile groove, so that the material region can be used for forming coded bittings to position the side locking tumblers in the cylinder key plug of the lock.

The main object indicated above is achieved, according to the present invention, by providing a cylinder lock and key combination, wherein the lock comprises a shell; a cylinder key plug rotatably mounted in the shell; a key slot extending longitudinally in the cylinder key plug for receiving a corresponding key cooperating with locking tumblers in the cylinder key plug. Further, the key comprises an elongated, substantially flat key blade extending between two mutually parallel side planes; at least one rectilinear profile groove extending along the entire length of the key blade in one side surface thereof and being defined by two opposite groove surfaces and a groove bottom surface. The key slot of the lock corresponds to the substantially flat shape of the key blade and is partially defined by a profile tongue located in the cylinder key plug and projecting into the key slot and which fits in the profile groove of the key blade upon insertion of the key blade.

The profile groove of the key is undercut in at least one groove surface so as to form an undercut portion and a ridge portion extending rectilinearly along the profile groove, an outside of the ridge portion forming a part of said one side surface of the key blade. The profile tongue of the cylinder key plug fills up the undercut portion of the profile groove of the key upon insertion of the key blade.

The present invention further provides an elongated, substantially flat key blade extending between two mutually parallel side planes and having a rectilinear profile groove which extends along an entire length of the key blade in one side surface thereof and which is defined by two opposite groove surfaces and a groove bottom surface, wherein the profile groove is undercut at at least one groove surface so as to form an undercut portion and a ridge portion extending rectilinearly along the profile groove, an outside of the ridge portion forming a part of the one side surface of the key blade.

At least one edge surface and/or at least one side surface and/or at least one groove in the key blade are provided with coded bittings to position the tumblers.

Also contemplated is a key blank for making a key, the key blank comprising an elongated, substantially flat key blade extended between two mutually parallel side planes and having a rectilinear profile groove extending along an entire length of the key blade in one side surface thereof and being defined by two opposite groove surfaces and a groove bottom surface, wherein the profile groove is undercut at at least one groove surface so as to form an undercut portion and a ridge portion extending rectilinearly along the profile groove, an outside of the ridge portion forming a part of the one side surface of the key blade.

Thus, the profile groove of the key is undercut at at least one groove surface while forming a ridge portion extending rectilinearly along the profile groove, the outside of the ridge portion forming a part of said one side surface of the key blade, wherein the profile tongue of the key plug fills up the undercut portion of the profile groove of the key upon insertion of the key blade.

By such an undercut profile groove, a great number of new key blank differs are generated. A key may be provided with one or more undercut profile grooves, in particular in combination with a number of other conventional profile grooves.

The ridge portion adjacent to each undercut profile groove strengthens the key blade so as to make it rigid against torsion and bending as well as wear resistant.

Flat keys with undercut profile grooves cannot be manufactured from ordinary, standard key blanks, because the process requires special equipment which is normally not available in typical workshops for key copying. Unauthorized key copying can therefore be prevented or at least made more difficult.

The above-mentioned further, secondary objects are achieved according to a further improvement of the invention, i.e., wherein the cylinder lock comprises at least one side tumbler which is movable in a cavity disposed to one side of the key slot and having a projection which extends into the key slot and cooperates with the key, the profile groove of the key having at least one coded side recess adjoining the one groove surface for cooperation with the projection upon insertion of the key into the cylinder lock, and wherein at least a portion of the coded side bitting area is formed in the ridge portion adjacent to the profile groove of the key.

Thus, the ridge portion formed adjacent to the undercut portion of the profile groove of the key is used as a material region for forming coded side bittings cooperating with side tumblers in the lock. These side tumblers, possibly with transversely projecting fingers, will at least partly be protected by the profile tongue of the key plug, so the lock will be very difficult to pick.

The present invention still further provides a lock comprising a shell; a cylinder key plug rotatably mounted in the shell and having tumblers disposed therein; a key slot extending longitudinally in the cylinder key plug and adapted to receive a key blade portion of an associated key which cooperates with the tumblers in the cylinder key plug, the key slot corresponding to a substantially flat form of the key blade and extending between two mutually parallel key slot side planes and being partially defined by a profile tongue disposed in the cylinder key plug. Further, the profile or projecting tongue is adapted to fill the undercut portion of a profile groove of the key blade upon insertion of the key blade.

It should be pointed out that undercut side grooves have been used before in keys. In a lock and key combination according to DE-A1-3225952 (Karrenberg), the key has a rectilinear, relatively and having oppositely located inclined walls. These short groove extending in the longitudinal direction and having oppositely located inclined walls. These grooves do not cooperate with any profile tongue of the lock, but only with a spring loaded pin in the cylinder key plug. This pin is movable in a direction transverse to the main plane of the key blade, and the head of the pin is conical, so that it fits into the undercut walls of the groove. Since the lock does not have any profile tongue cooperating with the groove, the groove cannot be denoted as a "profile groove".

BRIEF DESCRIPTION OF THE DRAWINGS

The invention will be explained further below with reference to the accompanying drawings illustrating the various embodiments, wherein.

DETAILED DESCRIPTION OF THE PREFERRED EMBODIMENTS

Figure 1A:
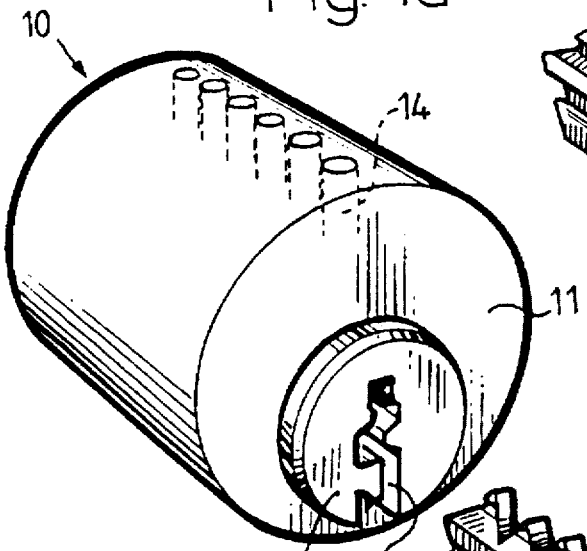
FIGS. 1*a* and 1*b* illustrate schematically in a perspective view a cylinder lock and a key, respectively, according to a first embodiment of the present invention.
Figure 2:
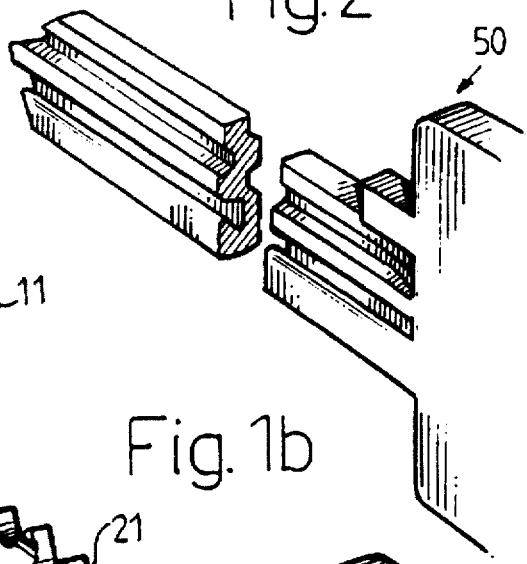
FIG. 2 illustrates, also in a perspective view, a key blank for making a key according to FIG. 1*b;*
Figure 1B:
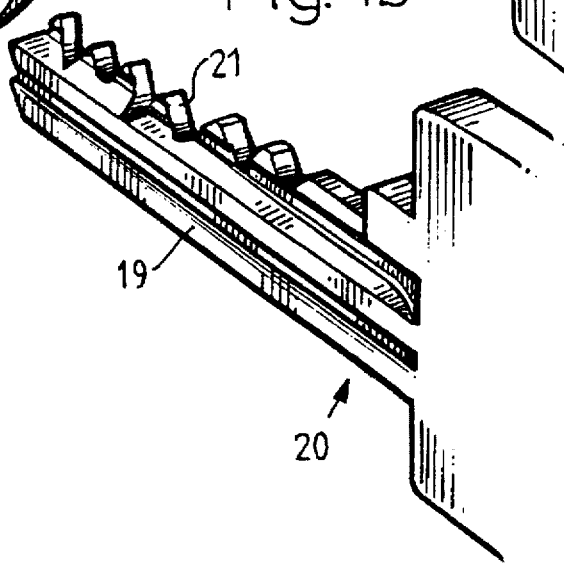
Figure 3:
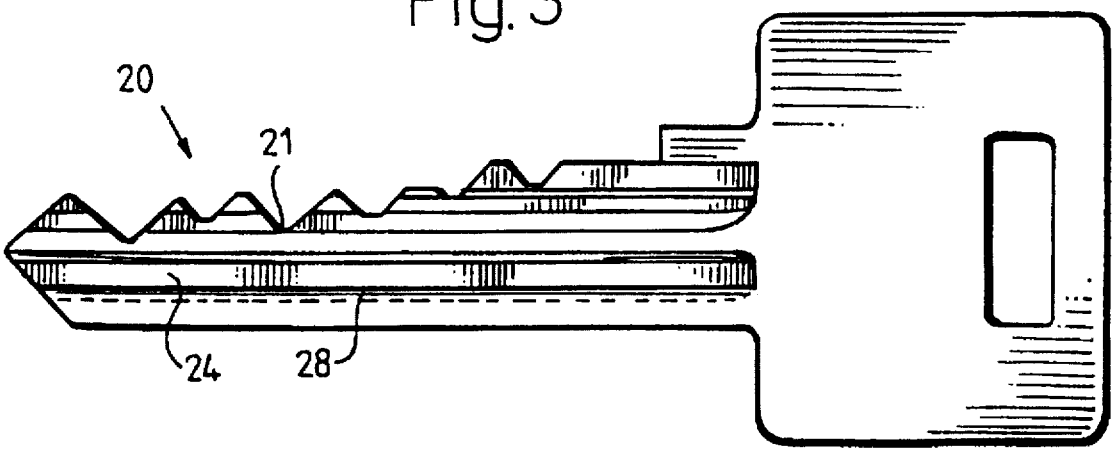
FIG. 3 is a side view of the key according to FIG. 1*b;*

The lock and key combination illustrated in FIGS. 1*a* and 1*b*, according to a first embodiment, comprises a cylinder lock 10 and a key 20, which is made of a key blank 50 (FIG. 2) The cylinder lock 10 comprises a shell 11 and a cylinder key plug 12 rotatable therein and having a longitudinal key slot 13. The lock has a row of central, spring-biased tumbler pins 14 with upper and lower pin portions 14*a*, 14*b* in the shell 11 and the cylinder key plug 12, respectively (see FIGS. 4 and 5).

The lower pin portions 14*b* of the tumbler pins cooperate, upon insertion of the key 20 into the lock 10, with V-shaped notches 21 in the upper edge portion of the key. If the key includes a key blade fitting into the lock 10, each lower pin 14*b* will be lifted by the corresponding key notch or bittings 21 into the position shown in FIG. 5, the contact area between the lower and upper pin portions 14*a*, 14*b* lying in the shear surface between the cylinder key plug 12 and the shell 11, so that the cylinder key plug 12 can be rotated.

The elongated key blade 19 of the key 20 (see the cross section in FIG. 6) is flat and extends in a main plane A between two side planes being mutually parallel and parallel to the main plane A, the side surfaces 22, 23 of the key blade 19 being located in these side planes. According to the invention, the key blade 19 has an undercut profile groove 24 in one side surface 22, apart from two upper, conventional profile grooves 22*a*, 23*a* in the side surfaces 22, 23.

The profile groove 24 is defined by an upper surface 25, which is substantially perpendicular to the side surface 22 (the left side in FIG. 6) and which is bevelled in the edge portion 25*a* forming a transition to the side surface 22, and a generally vertical wall 26, which forms the bottom of the groove, being parallel to the main plane A, as well as an angled surface 27. Vertical wall 26 optionally extends beyond main plane A (to the left or right of the main plane A in FIG. 6) providing paracentric protection from flat bladed lock picking tools. The angled surface 27 is inclined in such a way that the profile groove is undercut while forming a ridge portion 28, which extends rectilinearly along the profile groove. The angled surface 27 faces inwardly towards the vertical wall 26 of the groove 24, and the outside of the ridge portion 28 forms a part of the side surface 22 of the key blade 19.

As seen perpendicularly to the main plane A, towards the side surface 22 of the key blade 19, the ridge portion 28 will conceal the undercut inner portion 29 of the profile groove adjacent to the angled surface 27 and the groove vertical wall 26. In this case, the profile groove 24 is widened from the opening (in the plane of the side surface 22) in a direction towards the groove vertical wall 26.

Figure 4:
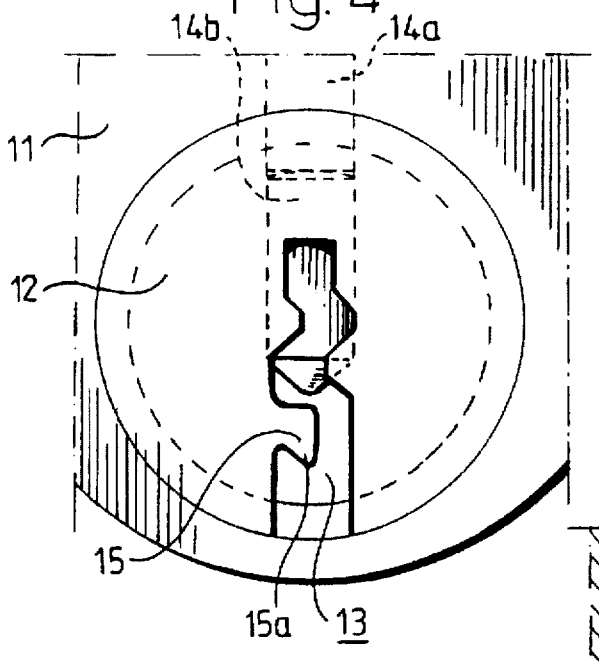
FIG. 4 is a fragmentary frontal view of the lock according to FIG. 1*a;*
Figure 5:
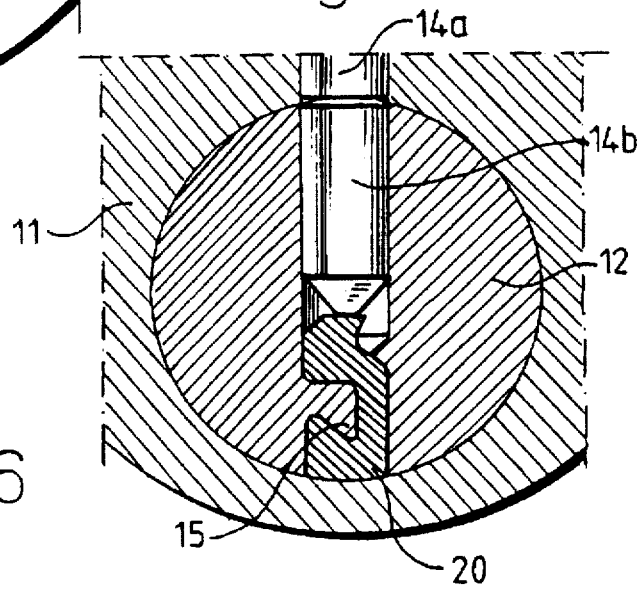
FIG. 5 is a cross section through the lock according to FIG. 1*a* upon insertion of the key.

As will be clear from FIGS. 4 and 5, the cylinder key plug 12 comprises, in the region of the key slot 13, a longitudinally extending profile tongue 15, the cross section of which corresponds to that of the profile groove 24 and has a downwardly projecting end portion 15*a*, which fills up the undercut portion 29 of the profile groove upon insertion of the key into the key slot 13.

An undercut profile groove 24 requires a special manufacturing process. Thus, it is necessary to make special key blanks according to FIG. 2, e.g., by milling with cutter disks of different thickness in several steps and with the axes of the cutter disks being differently inclined. Since such specialized equipment is not now generally available to the locksmithing and keymaking trades, the potential for counterfeiting such keys or keyblanks is minimal.

A great advantage with undercut profile grooves in the key blade is that the geometrical cross sectional shape can be varied to generate many more unique key sections than has been possible previously with "open" profile grooves, while maintaining sufficient strength, torsional rigidity and wear resistance of the key.

In FIGS. 23–30, various examples of such modifications are shown. It is understood that the key slots of the associated locks have tongue profiles which match the undercut grooves of corresponding keys.

Figure 23:
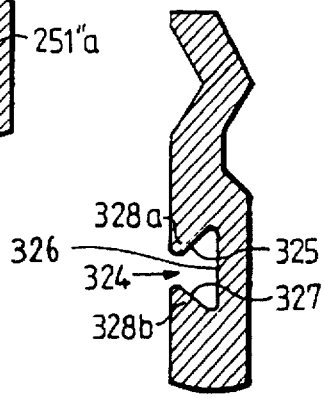
FIGS. 23–30 illustrate eight further variations of the profile groove of the key according to the present invention.

The key according to FIG. 23 has a profile groove 324 with two opposite undercut angled surfaces 325, 327 which are both inclined and face inwardly towards the vertical wall 326 of the groove. In this case, the groove 324 is widened inwardly towards the vertical wall 326, which is parallel to the main plane of the key. Two ridge portions 328*a* and 328*b* are formed at the angled surfaces 325 and 327, respectively.

Figure 24:
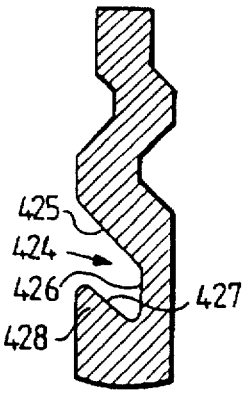

The key according to FIG. 24 has a profile groove 424 formed obliquely inwardly into the key blade, the angled surfaces 425 and 427 of the groove being inclined and mutually substantially parallel. The upper surface 425 faces outwardly from the groove, whereas the lower surface 427 is undercut adjacent to the ridge portion 428 and faces inwardly towards the vertical wall 426, which is parallel to the main plane of the key.

Figure 25:
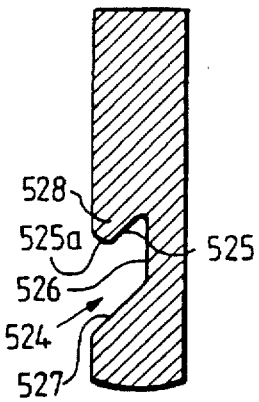

The key according to FIG. 25 also has a profile groove 524 formed obliquely inwardly (although upwards). The upper, undercut surface 525 has a bevel 525*a* at the transition to the side surface of the key and defines a ridge portion 528, whereas the lower surface 527 faces outwardly from the profile groove.

Figure 26:
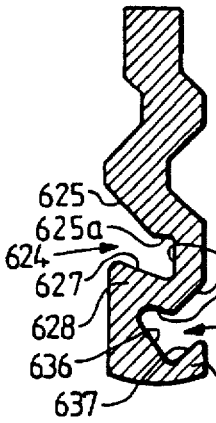

The key according to FIG. 26 has two undercut profile grooves 624, 634, one at each side surface. Each profile groove 624, 634 is cut so as to extend past the main or central plane of the key blade, though at different levels, so that a material bridge is formed between the profile grooves. Both profile grooves 624, 634 extend obliquely downwardly and have a lower, undercut surface 627 and 637, respectively, defining a ridge portion 628 and 638, respectively, and an upper surface 625 and 635, respectively, which internally merges into a flank portion 625*a*, which is perpendicular to the main plane, and a flank portion 635*a*, which faces inwardly towards the bottom 636 of the groove, respectively. The vertical wall 626 of the groove 624 is parallel to the main plane, whereas the surface 636 of the groove 634 is somewhat inclined in relation to the main plane.

Figure 27:
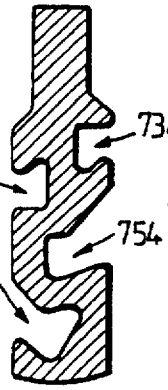

The key according to FIG. 27 has two upper, relatively shallow, undercut profile grooves 724, 734 and two lower, relatively deep profile grooves 744, 754. The two latter profile grooves 744, 754 correspond in their geometry to the profile grooves 634 and 624, respectively, in FIG. 26 (although reversed).

Figure 28:
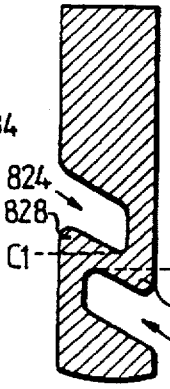

The key according to FIG. 28 has, at one side surface, an obliquely downwardly formed groove 824 (corresponding to the profile groove 424 in FIG. 24) and, at the other side surface, an obliquely upwardly formed groove 834 (approximately corresponding to the groove 524 in FIG. 25). The profile grooves 824 and 834 are located at different levels, and the two ridge portions 828 and 838 ensure that a strong material bridge is formed between the two profile grooves 824, 834. In an attempt to counterfeit a key according to FIG. 28 having "open" grooves instead of the undercut grooves, e.g., by removing the ridge portions 828, 838 to the dashed lines C1 and C2, the remaining material (between the lines C1 and C2) will be insufficiently strong for repeated use.

Figure 29:
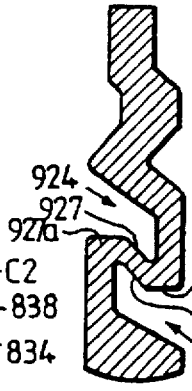

The key according to FIG. 29 has two profile grooves 924, 934 corresponding to the grooves 824, 834 in FIG. 28, although the undercut surfaces 927, 937 merge into a horizontal surface 927*a* and 937*a*, respectively, extending perpendicularly to the main plane of the key.

Figure 30:
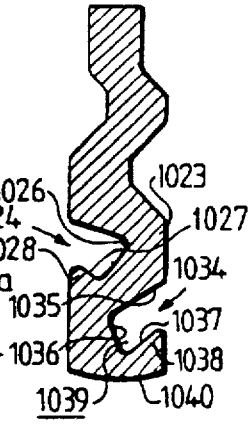

In the key according to FIG. 30, two profile grooves 1024 and 1034, respectively, formed at each side surface, are provided with undercut surfaces 1027 and 1037, respectively (defining a ridge portion 1028 and 1038, respectively), and with oblique bottom wall portions 1026 and 1036, respectively. The configuration is such that a material bridge is formed in the region between the bottom wall portion 1026 of the profile groove 1024 and the opposite surface 1035 of the profile groove 1034 being located at a somewhat lower level. Reference numeral 1023 denotes a side surface, 1039 the deepest portion of the undercut groove, and 1040 a lower edge surface of the key blade.

From the description above with reference to the FIGS. 6, 23, 24, 25, 26, 27, 28, 29 and 30, it should be clear that the variation possibilities are very great in terms of the number of undercut profile grooves, the relative location thereof as well as the individual shape thereof. A common advantage is that the ridge portion 28, 328*b*, 428, etc., adjacent to the respective undercut surface 27, 327, 427, etc., will give the key profile an increased strength, torsional rigidity and wear resistance. This is true not only for mutually adjacent profile grooves, such as the grooves 824 and 834 in FIG. 28, but also for profile grooves which are located close to the edge surface of the key, e.g., the groove 1034 in FIG. 30, where the deepest portion 1039 of the undercut groove is located very close to the lower edge surface 1040 of the key. However, the ridge portion 1038 will give the corner portion, i.e., the transition between the lower edge surface 1040 and the side surface 1023 of the key, increased stability and wear resistance.

A lock associated with a key having at least one undercut profile groove can be made highly pick-resistant by making the key slot (13 in FIGS. 1*a* and 4) narrow and forming one or more profile tongues so as to correspond to the respective profile grooves of the key. These profile tongues with downwardly projecting end portions, corresponding to the undercut portion of the respective profile grooves, make it more difficult to access and manipulate the locking tumblers through the key slot with conventional lock-picking tools.

A lock and key combination having at least one undercut profile groove in the key can be provided with many different kinds of locking tumblers in the lock and coded bittings in the key. Some further embodiments will be described below with reference to FIGS. 7*a*–13, FIGS. 14–18 and FIGS. 19–22, respectively.

Figure 8:
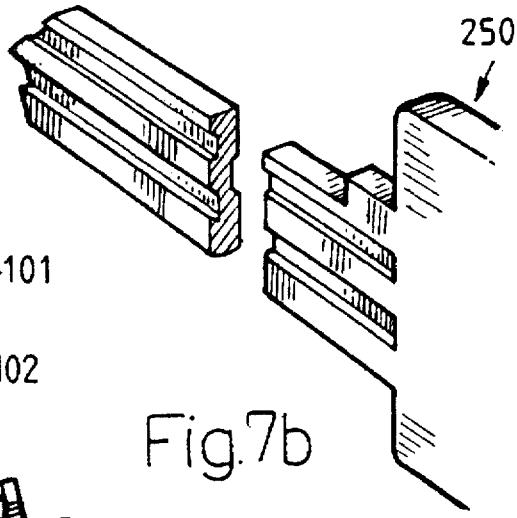
FIG. 8 illustrates, also in a perspective view, a key blank for making a key according to FIG. 7*b;*
Figure 7B:
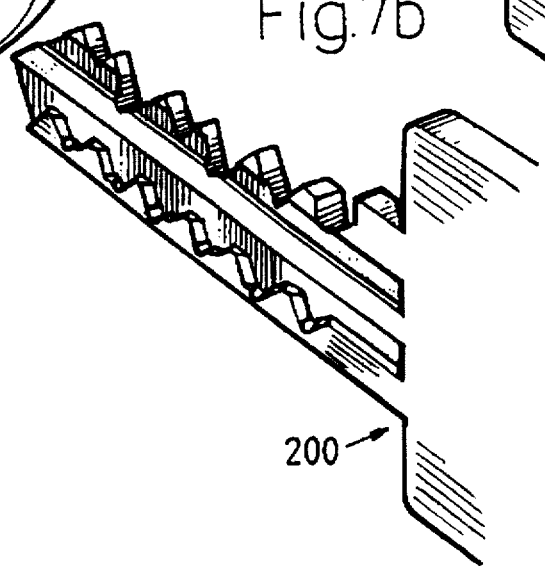
Figure 9:
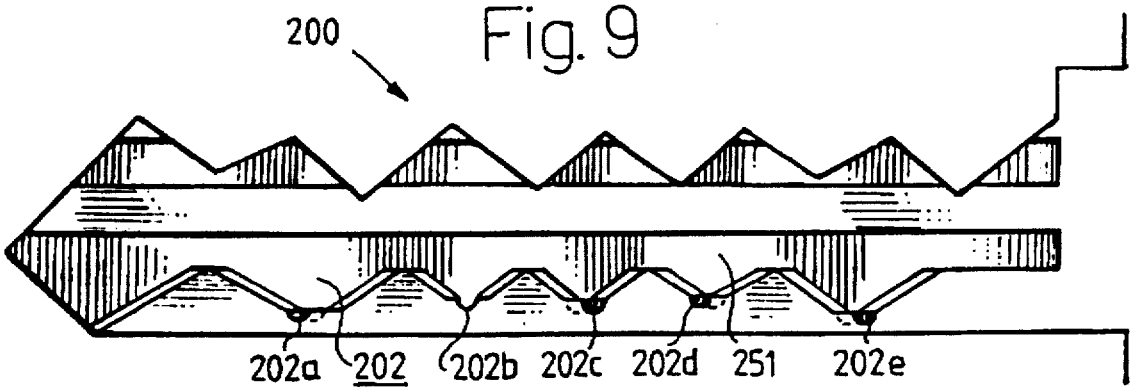
FIG. 9 is a side view of the key according to FIG. 7*b;*
Figure 10:
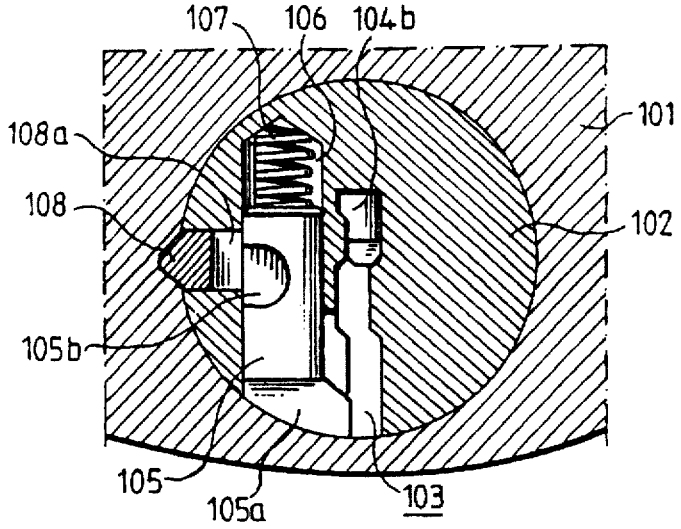
FIG. 10 is a cross section through the lock according to FIG. 7*a* in a plane passing through a locking pin cavity.
Figure 11:
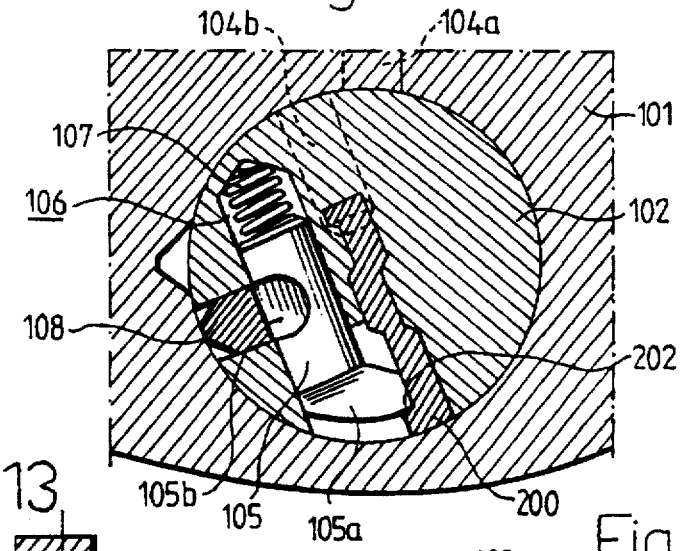
FIG. 11 is a cross section through the lock according to FIG. 7*a* upon insertion of the key and turning of the cylinder key plug.

In the second embodiment shown in FIGS. 7a–13, the combination comprises a cylinder lock 100 (FIG. 7a) and a key 200 (FIG. 7b, made of a key blank 250 according to FIG. 8).

The lock 100 has a shell 101 and a cylinder key plug 102 with a key slot 103. Apart from central, spring-biased tumbler pins 104 with upper and lower pin portions 104a, 104b (see FIGS. 10–12) in the shell 101 and the cylinder key plug 102, respectively, the lock has a number of side locking pins 105 which are located in a respective cavity 106 at the side of the key slot 103. Each side locking pin 105 has a transversely extending projection in the form of a finger 105a, which extends into the key slot 103 and, upon insertion of a key 200, cooperates with coded bittings 202 formed in the side surface of the key adjacent to a profile groove 251. As is previously known from the above-mentioned WO87/04749 (Widén Innovation AB), the side locking pins 105 in the embodiment according to FIGS. 7a–13 are mounted entirely in the pin cavities 106 and are spring-biased downwardly by springs 107, so that the respective finger 105a abuts the coded bittings 202 of the key 200, and are rotatable around their axes. Thus the respective fingers 105a upon insertion of a correct key 200, will be positioned in precise pivotal and elevational locations in the concavities 202a, 202b, 202c, 202d, 202e (FIG. 9) in the side bittings. Then, the side locking pins 105, with coded bittings or recesses 105b made in the cylindrical surface thereof resulting in a vertical blade portion 105c of the locking pin 105 and which interfaces with a vertical slot 108a of a side bar 108 (the blade portion 105c being visible from the side in FIG. 10), are positioned in such a way that the corresponding vertical opening or slot 108a of the side bar 108 permits the side bar 108 to fit over the aligned blade portion 105c of the corresponding locking pin enabling the side bar 108 to cam into the cylinder key plug 102 against the action of springs (not shown), so that the key plug can rotate in the shell 101 (see FIG. 11).

Figure 13:
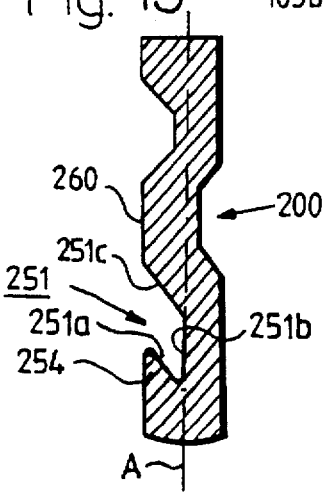
FIG. 13 is a cross section through the key according to FIGS. 3 and 9.
Figure 12:
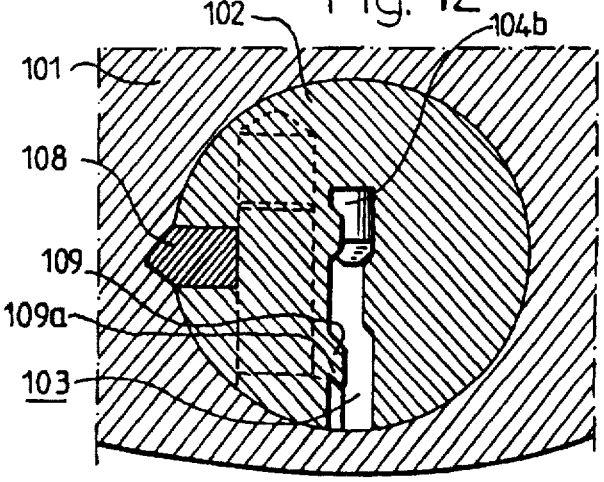
FIG. 12 is a cross section corresponding to FIG. 10, the cross sectional plane being located between the side tumblers of the lock.
Figure 14:
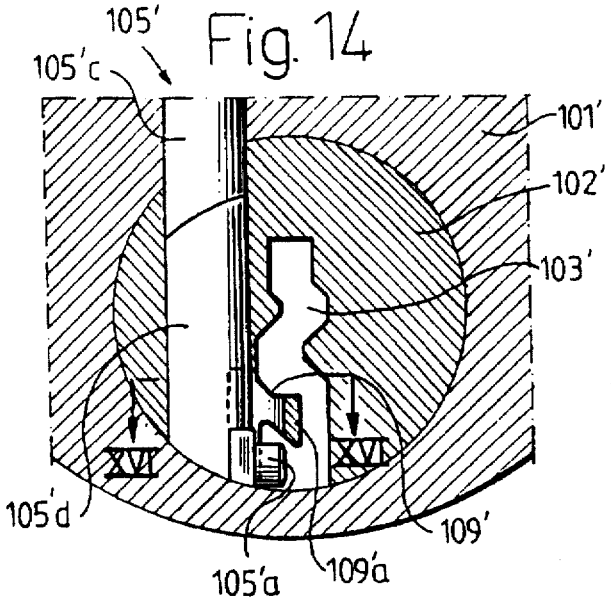
FIGS. 14, 15, 17 and 18 are views corresponding to FIGS. 10, 11, 9 and 13, respectively, concerning a third embodiment having non-rotatable side tumblers and a different profile groove in the key.
Figure 15:
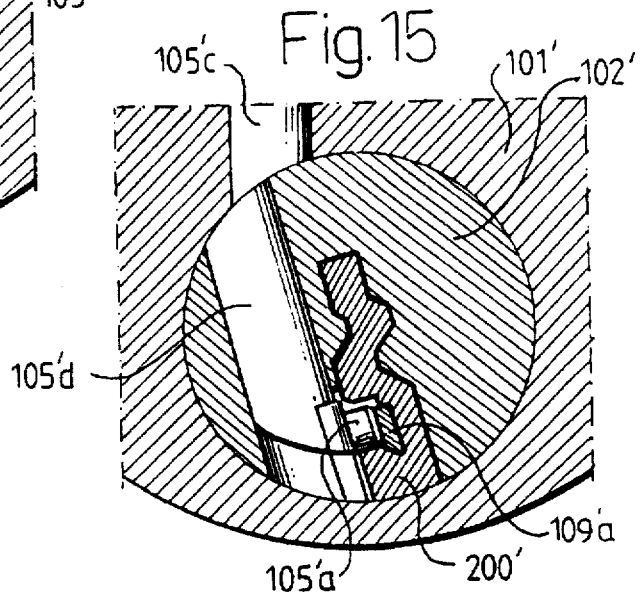

In this embodiment of the invention, the ridge portion 254 adjacent to an undercut portion of the profile groove 251 of the key is used as a bitting blade to rotationally and elevationally position the side locking pins. The profile groove 251 corresponds essentially to the profile groove 424 in FIG. 24 and, as appears best from FIG. 13, is undercut in its lower part, adjacent to its lower oblique surface 251a. The latter constitutes the inside of the ridge portion 254, whereas the outside of the ridge portion forms a part of the side surface 260 of the key. From FIG. 12, it is seen that the key slot 103 of the lock has a shape which corresponds to the profile of the key blade. A profile tongue 109 at the cylinder key plug 102 has a downwardly projecting end portion 109a which, upon insertion of the key, fills the undercut portion of the profile groove in the key.

Also, the side bittings 202 formed in the ridge portion 254 (see FIGS. 7b and 9) extend downwardly at incrementally different depths towards the lower edge of the key, and in some cases may extend slightly below the profile groove 251. Thus, in FIG. 9, the concavities 202a and 202e are situated below this level. In other respects, the side bittings 202 are formed in a similar manner as in the above-mentioned WO87/04749, i.e., they form a wave-like guide surface with concavities 202a–202e being irregularly distributed in the longitudinal direction, these concavities corresponding to specific pivotal and elevational positions of the associated fingers 105a of the side tumblers. In order to form well-defined seats for the side tumbler fingers, the concavities 202a–202e are provided with recessed portions, which are oriented in line with the respective side tumbler finger 105a, i.e., they are either obliquely oriented in one or the other direction or oriented perpendicularly to the main plane (A in FIG. 13) of the key 200.

The undercut profile groove 251 in the key and the corresponding profile tongue 109 with the obliquely downwardly projecting end portion 109a (in the key plug), which fits into the undercut portion of the profile groove inside the ridge portion 254 (see FIGS. 12 and 13), in this embodiment, have the additional advantage that the narrow key slot 103 in the lock 100 is even more narrow in the region of the side tumbler fingers 105a. Therefore, it is very difficult to reach the side tumbler fingers 105a with a picking tool and even more difficult to manipulate the latter into opening pivotal and elevational positions. The profile tongue 109 with its downwardly projecting end portion 109a protects the side tumblers of the lock against accidental damage or criminal tampering.

The angled undercut surface 251a of the profile groove 251, like the end portion 109a of the profile tongue 109 may be inclined to a varying degree, for use in master key systems to provide master and tenant keys with slightly different characteristics. Moreover, the angled surface 251c and the vertical wall 251b may be shaped differently, and the profile groove can of course also be combined with other profile grooves, as illustrated by the examples in FIGS. 23–30.

Figure 6:
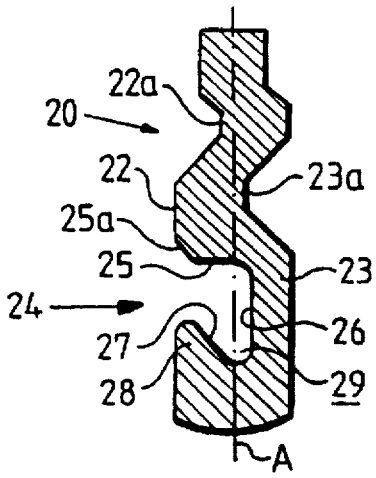
FIG. 6 is a cross section through the key blade according to FIG. 1*b* and FIG. 3.
Figure 7A:
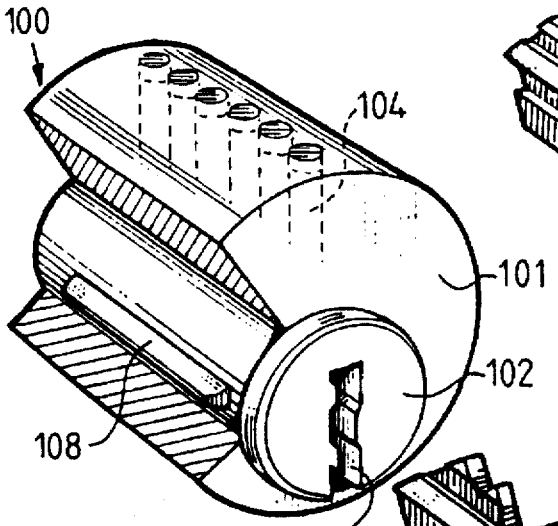
FIGS. 7*a* and 7*b* illustrate schematically in a perspective view of a lock and a key, respectively, according to a second embodiment.
Figure 16:
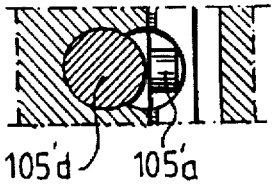
FIG. 16 is a partial section along the line XVI—XVI in FIG. 14.
Figure 17:
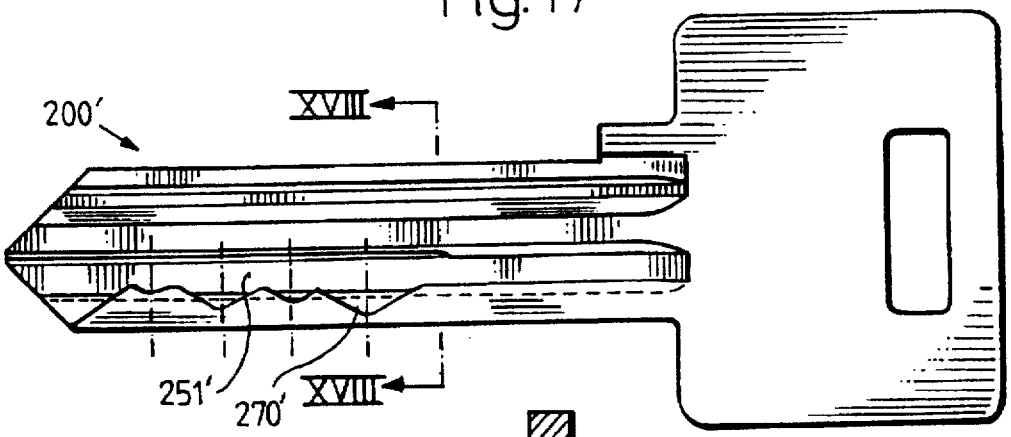
Figure 18:
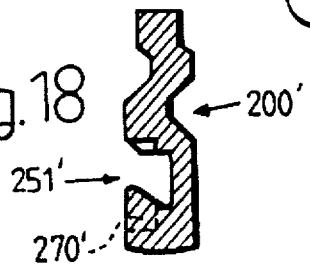
Figure 19:
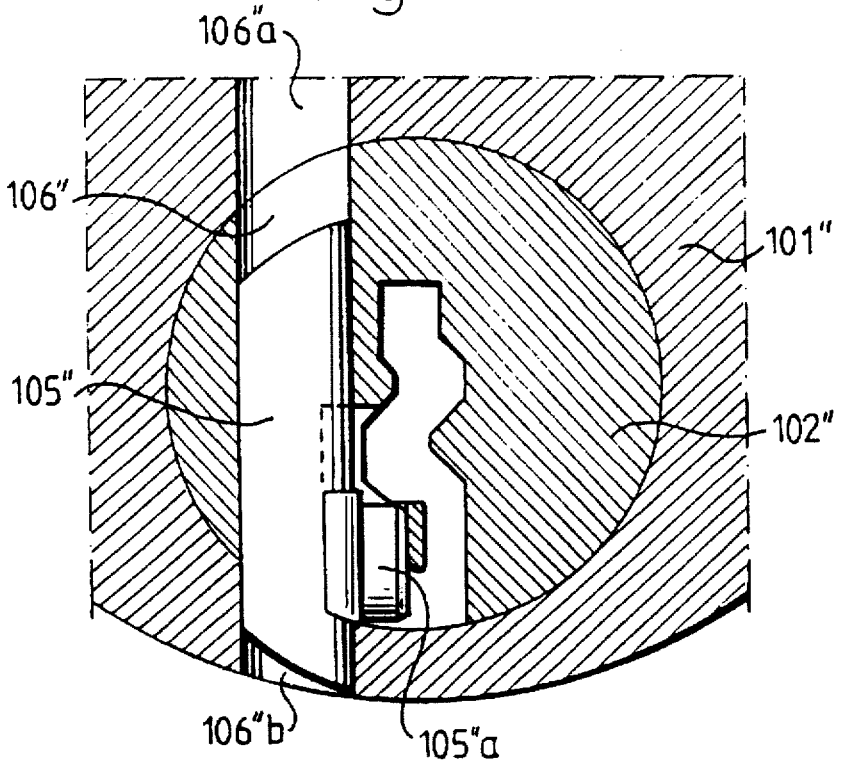
FIGS. 19, 20, 21 and 22 are views corresponding to FIGS. 14, 15, 17 and 18, respectively, of a fourth embodiment having side tumblers being positively guided in a wave-like groove of the key.

In the third embodiment illustrated in FIGS. 14–18, the key 200' has a profile groove 251', which approximately corresponds to the profile groove 24 in FIG. 6. In this third embodiment, similar elements to those of the previous second embodiment are denoted by similar reference numerals except that all reference numerals have been provided with a '-sign. The profile tongue 109' created in the key plug 102' of the lock extends in this case beyond the recesses for the side tumbler fingers 105'a, so that the profile tongue has a continuous, unitary edge portion 109'a. This embodiment differs from the second one in that the side tumblers 105' are non-rotatable and divided into upper and lower side tumbler pin portions 105'c and 105'd, respectively. Each side tumbler finger 105'a is centrally located on the respective lower side tumbler pin portion 105'd as shown in FIG. 16, and is acted upon by an associated concavity in the wave-like guide surface of the key (FIG. 17). The concavities are evenly distributed in the longitudinal direction. Alternatively, in a similar way as described in WO89/06733 (Widén Innovation AB), the fingers 105'a extending transversely into the key slot 103' may be specifically and irregularly distributed in the longitudinal direction of the cylinder key plug 102' relative to the axes of the pin portions 105'd, i.e., for cooperation with the side bittings being similarly distributed longitudinally along the wave-like guide surface of the key. The side tumblers may also cooperate with a side bar mechanism or device as described in the above-mentioned WO89/06733.

The upper side tumbler pin portions 105'c (see FIGS. 14 and 15) are biased downwardly by means of compression springs (not shown) in the shell 101', and the fingers 105'a will therefore engage the wave-like guide surface of the key 200'. This guide surface is formed by coded side bittings which are formed in a wave-like configuration in the ridge portion adjacent to the undercut portion of the profile groove. Upon insertion of a correct key 200', the side tumbler pin portions 105'c, 105'd will assume such elevational positions that the parting surface lies in the shear surface between the shell 101' and the cylinder key plug 102' so that the latter may be rotated with the key (see FIG. 15). As in the second embodiment, the lock may also have centrally located tumbler pins (not shown) which cooperate with V-shaped notches (not shown) in the upper edge of the key 200'.

The fourth embodiment of a lock and key combination according to the invention, as illustrated in FIGS. 19–22, differs from the previous ones, i.a., in that the respective side tumbler 105" is positively guided by engagement of its finger 105"*a* in a wavelike grove 270" of the key 200".

Figure 20:
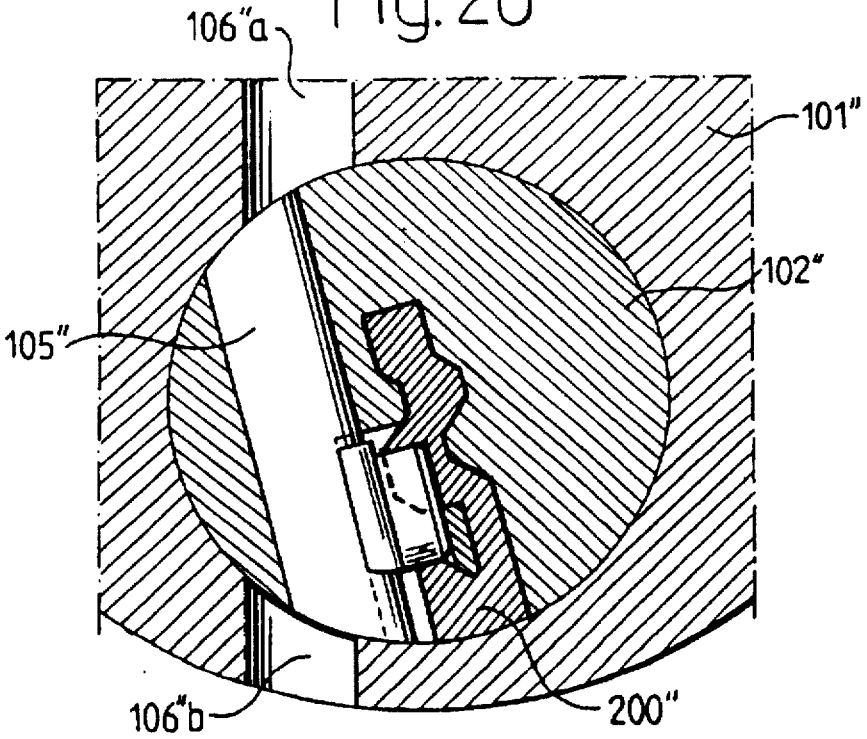
Figure 21:
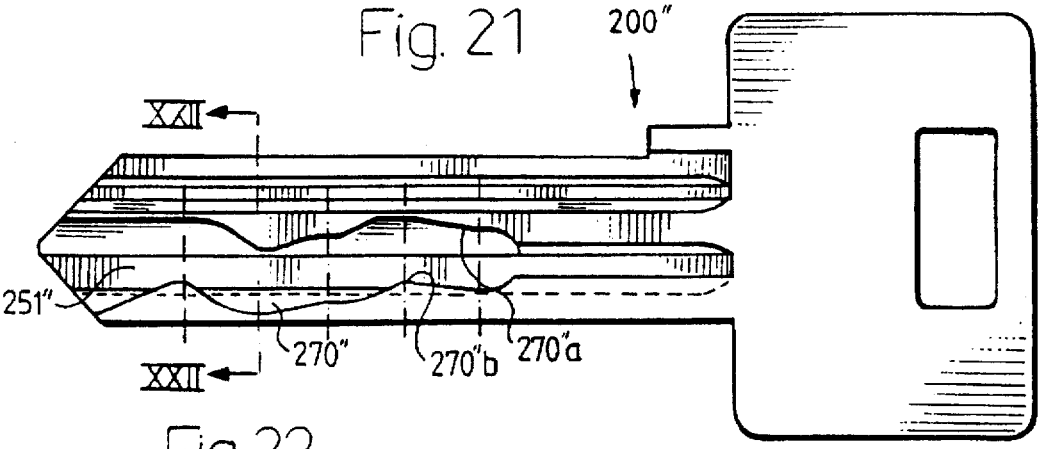

The side tumbler 105" is non-rotatably mounted for free vertical movement in the associated cavity 106" in the cylinder key plug, and upper and lower bores 106"*a* and 106"*b*, respectively, adjoin the cavity 106" in such a way that the tumbler may be displaced upwardly or downwardly so as to lock the cylinder key plug 102" against rotation in the shell 101". Only when the side tumbler 105" assumes a certain predetermined elevational position, the cylinder key plug 102" may be rotated, as illustrated in FIG. 20.

The finger 105"*a* extending transversely from the side tumbler 105" is relatively short in this case, but rather wide or high, so that it fits into the wave-like, relatively shallow groove 270" in the side surface of the key 200". Compare FIGS. 21 and 22. The groove 270" is defined by two opposite walls 270"*a*, 270"*b*, the mutual distance of which is substantially constant or somewhat exceeding the width or height of the side tumbler finger 105"*a*, so that the latter fits into the groove 270" and follows the wave contour moving the latter upwardly and downwardly when the key 200" is inserted or removed from the lock.

Figure 22:
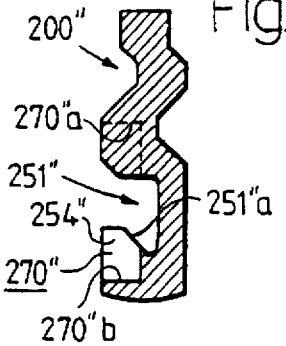

As appears best from FIG. 22, the groove 270" is more shallow than the profile groove 251", which extends rectilinearly along the key 200" and has substantially the same profile as in the third embodiment according to FIGS. 14–18, i.e., with an inclined lower groove side wall 251"*a* which defines a ridge portion 254". In this case, coded side recesses are formed in the ridge portion 254" as well as in the opposite part adjacent to the upper flank of the profile groove. These coded side recesses form the above-mentioned opposite walls 270"*a*, 270"*b* which in turn define the wave-like forcedly guiding groove 270".

The above description of four embodiments makes it clear that the undercut profile grooves in the key may be combined with a plurality of different types of tumblers in the lock and code patterns on the key. As a further non-illustrated example one can mention side tumblers which are obliquely or perpendicularly oriented transversely in relation to the key slot of the lock and cooperate with one end portion directly with coded side bittings adjacent to the undercut profile groove of the key. Likewise, the tumblers (even the side tumblers) may be provided with chisel-shaped end portions which permit positioning of the tumblers axially as well as rotationally, i.e., by cooperation with differently inclined notches or recesses in the key. Such oblique notches or recesses may be formed in the upper or lower edge portion of the flat key or in a ridge portion, which adjoins the undercut profile groove of the key blade. It should also be pointed out that the term "side tumbler" means any tumbler located in the cylinder key plug at the side of the vertical plane extending centrally through the key slot of the lock (e.g., 103 in FIG. 10).

The feature that "the outside of the ridge portion forms a part of said one side surface of the key blade" is to be interpreted as meaning that the key blade should be substantially of the same thickness above and below the profile groove, so that the outside of the ridge portion is situated substantially in the associated side plane of the key blade. Of course, the ridge portion may be rounded or bevelled in the transition region to the profile groove, and it is also conceivable that the outside of the ridge portion is somewhat retracted or projected in relation to the associated side plane.

The key may also be provided with various kinds of coded bittings in other regions than adjacent to the ridge portion, i.e., on any edge or side surface of the key or in a profile groove.

It is contemplated that numerous modifications may be made to the cylinder lock and key of the present invention without departing from the spirit and scope of the invention as defined in the following claims.

What is claimed is:

1. A cylinder lock and key combination, said cylinder lock comprising:

a shell (11);

a cylinder key plug (12) rotatably mounted in said shell and having tumblers (14) disposed therein; and a key slot (13) extending longitudinally in said cylinder key plug for receiving an associated key which cooperates with said tumblers (14) in said cylinder key plug;

said key comprising:

an elongated, substantially flat key blade (20) extending between two side surfaces and between longitudinal upper and lower edges, said lower edge extending continuously along substantially an entire length of said key blade; and at least one rectilinear profile groove (24) extending along said entire length of said key blade in one of said side surfaces (22) thereof and being defined by two opposite groove surfaces (25, 27) and a groove bottom surface (26);

wherein said key slot of said cylinder lock corresponds to the substantially flat shape of said key blade and is partially defined by a fixed and rectilinear profile tongue (15) disposed in said cylinder key plug and fixed thereto and projecting into said profile groove (24) of the key blade;

and further wherein said profile groove (24) of said key is undercut at at least a groove surface (27) located closest to said substantially continuous lower edge of said key blade and said undercut groove surface (27) extends in a substantially flat surface which is inclined in such a way as to face inwardly towards said groove bottom surface (26), at an acute angle with respect to said groove bottom surface, and to form an undercut groove portion (29) located inside a ridge portion (28) extending rectilinearly along said undercut profile groove, an outside of said ridge portion forming a part of said one side surface (22) of said key blade (20), and said fixed and rectilinear profile tongue (15) of said cylinder lock has a downwardly projecting end portion, which fills up said undercut portion (29) of said profile groove (24) of said key upon insertion of said key blade.

2. A cylinder lock and key combination, said cylinder lock comprising:

a shell (11);

a cylinder key plug (12) rotatably mounted in said shell and having tumblers (14) disposed therein; and a key slot (13) extending longitudinally in said cylinder key plug for receiving an associated key which cooperates with said tumblers (14) in said cylinder key plug;

said key comprising:

an elongated, substantially flat key blade (20) extending between two side surfaces and between longitudinal upper and lower edges; and at least one rectilinear profile groove (24) extending along an entire length of said key blade in one of said side surfaces (22) thereof and being defined by two opposite groove surfaces (25, 27) and a groove bottom surface (26) which is substantially parallel to said side surfaces of the key blade;

wherein said key slot of said cylinder lock corresponds to the substantially flat shape of said key blade and is partially defined by a fixed, rectilinear and substantially continuous profile tongue (15) disposed in said cylinder key plug and fixed thereto and projecting into said profile groove (24) of the key blade;

and further wherein said profile groove (24) of said key is undercut at at least one groove surface (27), and said undercut groove surface (27) extends in a substantially flat surface which is inclined in such a way as to face inwardly towards said groove bottom surface (26), at an acute angle with respect to said groove bottom surface, and to form an undercut groove portion (29) located inside a ridge portion (28) extending rectilinearly along said undercut profile groove, an outside of said ridge portion forming a part of said one side surface (22) of said key blade (20), said fixed, rectilinear and substantially continuous profile tongue (15) of said cylinder lock has a projecting end portion, which fills up said undercut profile groove (24) of said key upon insertion of said key blade.

3. The combination according to claim 1 or 2, wherein said undercut profile groove (24) is widened inwardly towards the groove bottom surface (26) and wherein said projecting end portion of said profile tongue fills up said inwardly widened profile groove (24) of said key upon insertion of said key blade.

4. A cylinder lock and key combination, said cylinder lock comprising:

a shell;

a cylinder key plug rotatably mounted in said shell and having tumblers disposed therein; and a key slot extending longitudinally in said cylinder key plug for receiving an associated key which cooperates with tumblers in said cylinder key plug;

at least one side tumbler being movable in a cavity disposed to one side of said key slot and having a side tumbler projection which extends into said key slot and cooperates with said key;

said key comprising:

an elongated, substantially flat key blade extending between two side surfaces and between longitudinal upper and lower edges; and at least one rectilinear profile groove extending along an entire length of said key blade in one of said side surfaces thereof and being defined by two opposite groove surfaces and a groove bottom surface, at least one groove surface being undercut so as to form a ridge portion extending rectilinearly along said profile groove, an outside of said ridge portion forming a part of said one side surface of said key blade, said undercut groove surface extending in a substantially flat surface which is inclined in such a way as to face inwardly towards said groove bottom surface, at an acute angle with respect to said groove bottom surface, and to form an undercut groove portion located inside said ridge portion extending rectilinearly along said undercut profile groove;

wherein said key slot of said cylinder lock corresponds to the substantially flat shape of said key blade and is partially defined by a fixed and rectilinear profile tongue disposed in said cylinder key plug and fixed thereto and projecting into said undercut profile groove upon insertion of the key blade;

and wherein said key blade has a plurality of coded side bittings in said outside of said ridge portion for cooperation with said side tumbler projection of said cylinder lock, said coded side bittings forming a wave-like guide surface extending longitudinally in said ridge portion adjacent to said undercut profile groove of said key.

5. The combination according to claim 4, wherein said side tumbler is spring-biased so that said side tumbler projection is kept in contact with said wave-like guide surface of said key blade upon insertion of said key blade.

6. The combination according to claim 4, wherein said side tumbler projection is positively guided by said wave-like guide surface of said key blade upon insertion of said key blade.

7. A key comprising:

an elongated, substantially flat key blade extending between two side surfaces and between longitudinal upper and lower edges, said lower edge extending continuously along substantially an entire length of said key blade, said lower edge adapted to be adjacent to an outer surface of a cylinder key plug of an associated lock when said key is inserted, said key blade having a rectilinear profile groove (24) which extends along said entire length of said key blade in at least one of said side surfaces thereof and being defined by two opposite groove surfaces and a groove bottom surface (26), wherein said profile groove (24) is undercut at at least a groove surface (27) located closest to said substantially continuous lower edge of said key blade so as to form a ridge portion (28) extending rectilinearly along the profile groove, and said undercut groove surface (27) extends in a substantially flat surface which is inclined in such a way as to face inwardly towards said groove bottom surface (26), at an acute angle with respect to said groove bottom surface, and to form an undercut groove portion (29) located inside said ridge portion (28) extending rectilinearly along said undercut profile groove, an outside of said ridge portion forming a part of said one side surface (22) of said key blade (20).

8. The key according to claim 7, wherein at least one side surface is provided with coded bittings.

9. A key comprising:

an elongated, substantially flat key blade extending between two side surfaces and between longitudinal upper and lower edges, said key blade having a rectilinear profile groove (24) which extends continuously along an entire length of said key blade in at least one of said surfaces thereof and being defined by two opposite groove surfaces and a groove bottom surface (26) which is substantially parallel to said side surfaces of the key blade, wherein said groove (24) is undercut at at least one groove surface (27), and said undercut groove surface (27) extends in a substantially flat surface which is inclined in such a way as to face inwardly towards said groove bottom surface (26), at an acute angle with respect to said groove bottom surface, and to form an undercut groove (29) located inside a ridge portion (28) extending rectilinearly along said undercut profile groove, an outside of said ridge portion forming a part of said one side surface (22) of said key blade (20).

10. The key according to claim 7 or 9, wherein said undercut profile groove (24) is widened inwardly towards the groove bottom surface (26).

11. The key according to claim 7 or 9, wherein both of said two opposite groove surfaces of said profile groove of said key are undercut while forming two opposite ridge portions.

12. The key according to claim 7 or 9, wherein said two opposite groove surfaces of said undercut profile groove are substantially parallel to each other.

13. The key according to claim 7 or 9, wherein at least one groove surface of said undercut groove is divided into two surface portions (625, 625*a*) extending in different planes.

14. The key according to claim 7 or 9, wherein at least one undercut, profile groove (824, 834) is formed in each side surface.

15. The key according to claim 14, wherein two undercut profile grooves (824, 834) are formed in a respective side surface at different levels, each with a depth exceeding half the thickness of said key blade, wherein the two undercut profile grooves form between them a material bridge extending through said key blade.

16. The key according to claim 15, wherein said material bridge includes at least one ridge portion (828, 838) associated with a respective undercut profile groove.

17. A key comprising:

an elongated, substantially flat key blade extending between two side surfaces and between longitudinal upper and lower edges, said key blade having a rectilinear profile groove (24) extending along an entire length of said key blade in one of said side surfaces thereof and being defined by two opposite groove surfaces (25, 27) and a groove bottom surface (26), wherein at least one of said groove surfaces (27) is undercut so as to form a ridge portion (28) extending rectilinearly along the profile groove, an outside of said ridge portion forming a part of said one side surface (22) of said key blade (20), said undercut groove surface (27) extending in a substantially flat surface which is inclined in such a way as to face inwardly towards said groove bottom surface (26), at an acute angle with respect to said groove bottom surface, and to form an undercut groove portion (29) located inside said ridge portion (28) extending rectilinearly along said undercut profile groove, and wherein said key blade has a plurality of coded side bittings in said outside of said ridge portion for cooperation with at least one side tumbler projection (105*a*) of an associated lock (100), said coded side bittings forming a wave-like guide surface extending longitudinally in said ridge portion adjacent to said undercut profile groove.

18. The key according to claim 17, wherein said wave-like guide surface forms concavities (202*a–e*) for cooperation with said at least one side tumbler projection, said concavities being irregularly distributed in a longitudinal direction.

19. The key according to claim 18, wherein said wave-like guide surface forms concavities, one for each side tumbler projection, said concavities being regularly distributed in a longitudinal direction.

20. A key comprising:

an elongated, substantially flat key blade extending between two side surfaces and between longitudinal upper and lower edges, said key blade having a rectilinear profile groove which extends along an entire length of said key blade in one of said side surfaces thereof and being defined by two opposite groove surfaces and a groove bottom surface, wherein said profile groove is undercut at at least one groove surface so as to form a ridge portion extending rectilinearly along the profile groove, an outside of said ridge portion forming a part of said one side surface of said key blade, said key blade further having a plurality of coded side bittings, which form two guide surfaces (270"*a*, 270"*b*) extending on each side of said undercut profile groove (251") and being mutually substantially parallel, wherein a distance therebetween corresponds essentially to a height of a side tumbler projection (105"*a*) of an associated lock.

21. A key blank (50) for making a key, said key blank comprising:

an elongated, substantially flat key blade extending between two mutually parallel side surfaces and between longitudinal upper and lower edges, said lower edge extending continuously along substantially an entire length of said key blade, said lower edge adapted to be adjacent to an outer surface of a cylinder key plug of an associated lock when said key blank is inserted, said key blade having a rectilinear profile groove extending along said entire length of said key blade in one side surface (22) thereof and being defined by two opposite groove surfaces (25, 27) and a groove bottom surface (26), wherein said profile groove (24) is undercut at at least a groove surface located closest to said substantially continuous lower edge of said key blade so as to form a ridge portion (28) extending rectilinearly along said undercut profile groove, an outside of said ridge portion forming a part of said one side surface (22) of said key blade, said undercut groove surface (27) extending in a substantially flat surface which is inclined in such a way as to face inwardly towards said groove bottom surface (26), at an acute angle with respect to said groove bottom surface, and to form an undercut groove portion (29) located inside said ridge portion (28) extending rectilinearly along said undercut profile groove.

22. The key blank according to claim 21, wherein said profile groove (24) is deeper than half the thickness of said key blade (20).

23. A key blank for making a key, said key blank comprising:

an elongated, substantially flat key blade extending between two mutually parallel side surfaces and between longitudinal upper and lower edges, said key blade having a rectilinear profile groove (24) which extends along an entire length of said key blade in one of said side surfaces thereof and being defined by two opposite groove surfaces and a groove bottom surface (26) which is substantially parallel to said side surfaces of the key blade, wherein said groove (24) is undercut at at least one groove surface (27), and said undercut groove surface (27) extends in a substantially flat surface which is inclined in such a way as to face inwardly towards the groove bottom surface (26), at an acute angle with respect to said groove bottom surface, and to form an undercut groove portion (29) located inside a ridge portion (28) extending rectilinearly along said undercut profile groove, an outside of said ridge portion forming a part of said one side surface (22) of said key blade (20).

24. A key blank according to claim 23, wherein said undercut profile groove (24) is widened inwardly towards the groove bottom surface (26).

25. A key blank for making a key, said key blank comprising:

an elongated, substantially flat key blade extending between two mutually parallel side surfaces and between longitudinal upper and lower edges, said key blade having a rectilinear profile groove (24) extending along an entire length of said key blade in one of said side surfaces thereof and being defined by two opposite groove surfaces and a groove bottom surface (26), wherein at least one of said groove surfaces (27) is undercut so as to form a ridge portion (28) extending rectilinearly along the profile groove, an outside of said ridge portion forming a part of said one side surface (22) of said key blade (20), said undercut groove surface (27) extending in a substantially flat surface which is inclined in such a way as to face inwardly towards said groove bottom surface (26), at an acute angle with respect to said groove bottom surface, and to form an undercut groove portion (29) located inside said ridge portion (28) extending rectilinearly along said undercut profile groove, and wherein said key blade has a plurality of coded side bittings in said outside of said ridge portion for cooperation with a side tumbler projection (105*a*) of an associated lock (100), said coded side bittings forming a wave-like guide surface extending longitudinally in said ridge portion adjacent to said undercut profile groove.

* * * * *